US005911364A

United States Patent [19]

Johnson et al.

[11] Patent Number: 5,911,364

[45] Date of Patent: Jun. 15, 1999

[54] REVERSIBLE TIP DETENT

[75] Inventors: Shawn C. Johnson, Milaca; Thomas F. Kruzel, Maple Grove, both of Minn.

[73] Assignee: Wagner Spray Tech Corporation, Minneapolis, Minn.

[21] Appl. No.: 08/902,208

[22] Filed: Jul. 29, 1997

[51] Int. Cl.[6] ..... B05B 15/02

[52] U.S. Cl. ..... 239/119; 239/600

[58] Field of Search ..... 239/119, 288, 239/392, 393, 403, 600; 403/329, 326, 328

[56] References Cited

U.S. PATENT DOCUMENTS

| | | | |
|---|---|---|---|
| 2,564,431 | 8/1951 | Greenspoon | 299/107 |
| 3,116,882 | 1/1964 | Vork | 239/587 |
| 3,202,360 | 8/1965 | O'Brien | 239/119 |
| 3,460,757 | 8/1969 | Adams | 239/119 |
| 3,593,920 | 7/1971 | Watson | 239/119 |
| 3,645,450 | 2/1972 | Calder | 239/116 |
| 3,667,681 | 6/1972 | Blancha | 239/393 |
| 3,686,896 | 8/1972 | Rutter | 64/4 |
| 3,707,303 | 12/1972 | Petri | 403/326 |
| 3,752,400 | 8/1973 | Calder | 239/116 |
| 3,831,862 | 8/1974 | Calder | 239/526 |
| 3,955,763 | 5/1976 | Pyle et al. | 239/119 |
| 4,074,857 | 2/1978 | Calder | 239/119 |
| 4,108,379 | 8/1978 | Talley | 239/119 |
| 4,116,386 | 9/1978 | Calder | 239/119 |
| 4,157,163 | 6/1979 | Pinto et al. | 239/119 |
| 4,165,836 | 8/1979 | Eull | 239/119 |
| 4,437,610 | 3/1984 | Huber et al. | 239/119 |
| 4,465,236 | 8/1984 | Calder | 239/391 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,513,913 | 4/1985 | Smith | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,629,121 | 12/1986 | Hengesbach | 239/119 |
| 4,635,850 | 1/1987 | Leisi | 239/119 |
| 4,682,731 | 7/1987 | Bolton | 239/119 |
| 4,715,537 | 12/1987 | Calder | 239/119 |
| 4,736,892 | 4/1988 | Calder | 239/592 |
| 4,757,947 | 7/1988 | Calder | 239/119 |
| 4,819,872 | 4/1989 | Rosenberg | 239/119 |
| 4,830,281 | 5/1989 | Calder | 239/119 |
| 4,971,249 | 11/1990 | Tam et al. | 239/119 |
| 5,094,402 | 3/1992 | Perret, Jr. et al. | 239/526 |
| 5,255,848 | 10/1993 | Rhodehouse | 239/119 |
| 5,280,853 | 1/1994 | Perret | 239/119 |
| 5,294,053 | 3/1994 | Perret, Jr. | 239/119 |
| 5,340,029 | 8/1994 | Adams | 239/119 |
| 5,379,938 | 1/1995 | Perret, Jr. | 239/119 |
| 5,379,939 | 1/1995 | Perret, Jr. | 239/119 |
| 5,454,515 | 10/1995 | Perret | 239/119 |
| 5,505,381 | 4/1996 | Torntore | 239/119 |

FOREIGN PATENT DOCUMENTS 0 804 969 A2 11/1997 European Pat. Off. .

*Primary Examiner*—Andres Kashnikow
*Assistant Examiner*—Dinh Q. Nguyen
*Attorney, Agent, or Firm*—Faegre & Benson LLP

[57] ABSTRACT

A detent apparatus and method for rotatably retaining a paint spray tip and turret in a holder to permit rotation of the turret to selectively position the tip to a spraying position and a cleaning position and to selectively permit extraction and insertion of the turret with respect to the holder by actuation of the detent apparatus which is preferably made up of a protrusion and mating recess and shoulder, with a spring portion permitting relative movement of the elements of the detent apparatus to permit withdrawal and insertion of the turret with respect to the holder.

17 Claims, 5 Drawing Sheets

REVERSIBLE TIP DETENT

BACKGROUND OF THE INVENTION

This invention relates to the field of reversible airless paint spray tips and holders for portable spray guns. In such arrangements, a small orifice is used to atomize paint under relatively high pressure with the tip in a spraying position. When the orifice becomes clogged, the tip is rotated (reversed) 180 degrees in the holder to a cleaning position and the gun is triggered to clear the obstruction, after which the tip is rotated back to the atomization position. In the past, such tips either had a gate arrangement allowing removal of the tip only at a position intermediate the spraying and cleaning positions or did not have any restraint against removal of the tip at any angle of rotation. The gate arrangement requires the user to precisely position the turret containing the tip to a location exactly halfway between the spraying and cleaning positions. The freely removable version allowed the turret and tip to slip laterally as the turret is rotated with the result that the tip can become unintentionally misaligned in the spraying or cleaning position. The present invention overcomes these aspect of prior designs by providing an arrangement which holds the turret in alignment with the holder and simultaneously permits rotation of the tip to the spraying and cleaning positions and also has a detent mechanism to permit removal and replacement of the turret and tip at any angular position of the turret with respect to the holder.

DETAILED DESCRIPTION OF THE INVENTION

Figure 1:
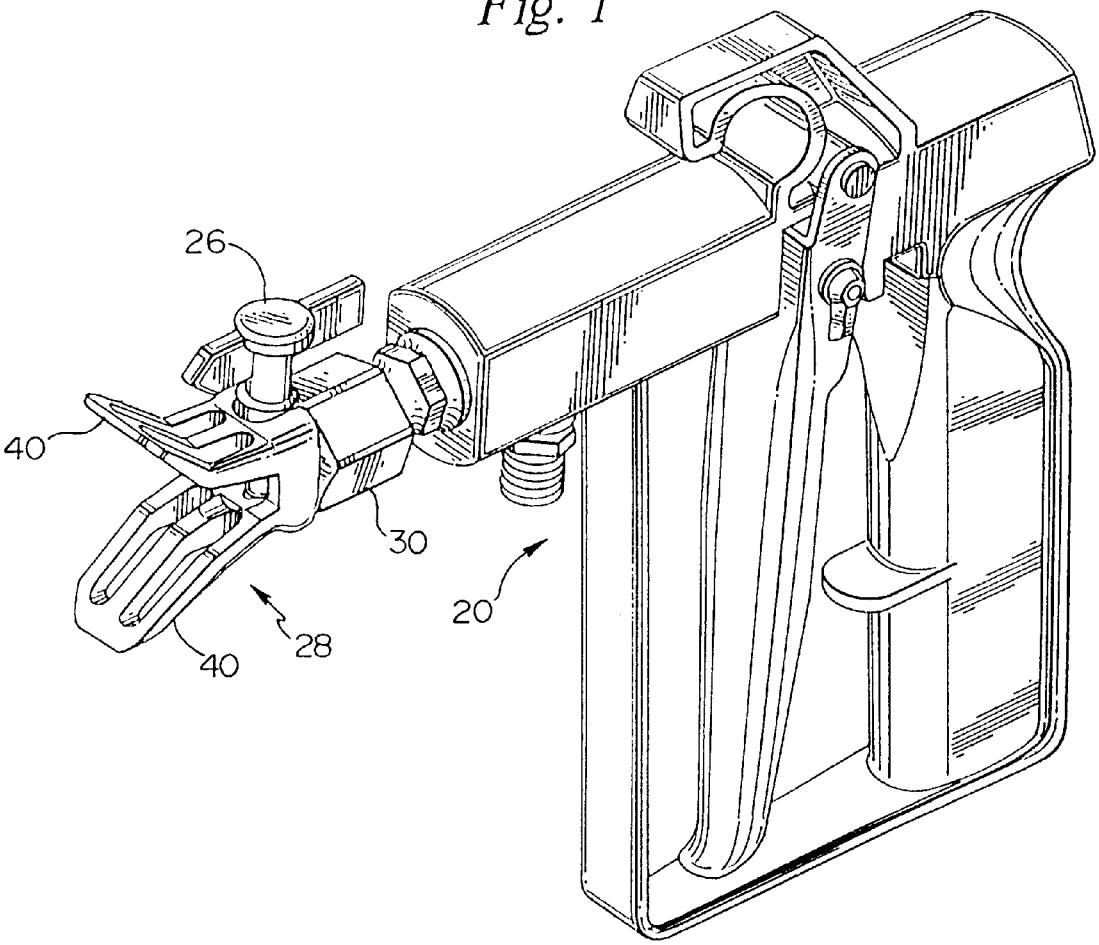
FIG. 1 is a perspective view of a paint spray gun carrying a tip holder and reversible spray tip useful in the practice of the present invention.
Figure 10:
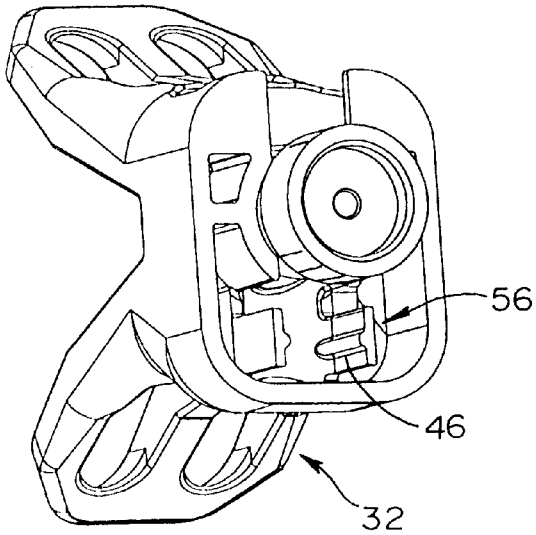
FIG. 10 is a perspective view of the tip holder shown in FIGS. 6–9.
Figure 2:
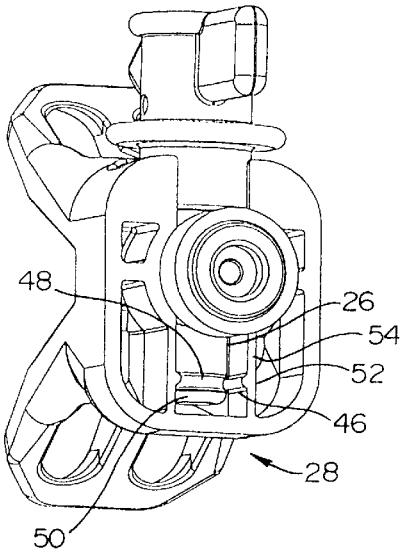
FIG. 2 is a perspective view of a first embodiment of the tip holder and reversible spray tip assembly useful in the practice of the present invention.
Figure 4:
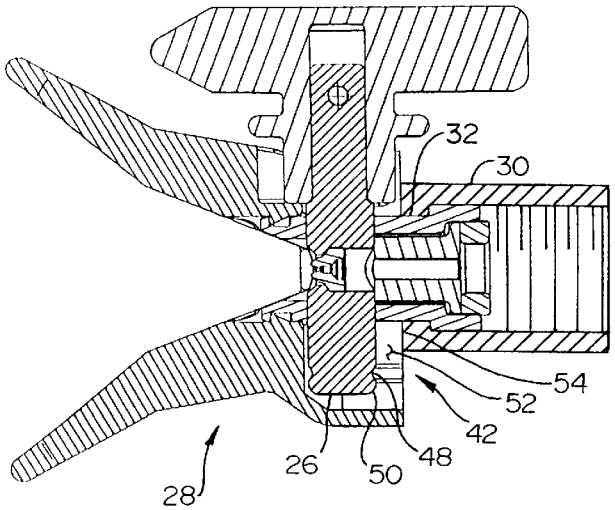
FIG. 4 is a side elevation view in section taken along line 4—4 of FIG. 3, with a nut added to the rear of the assembly of FIG. 2.
Figure 3:
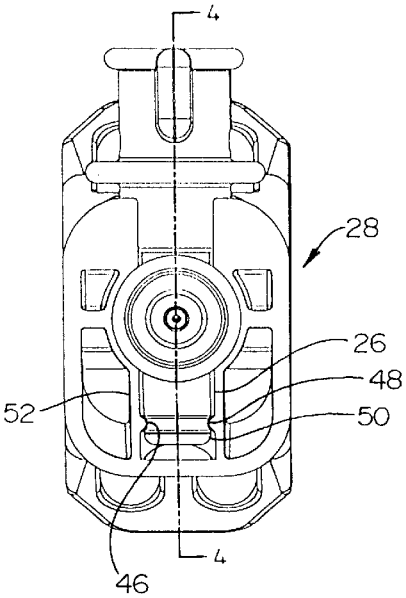
FIG. 3 is a rear elevation view of the assembly of FIG. 2.
Figure 5:
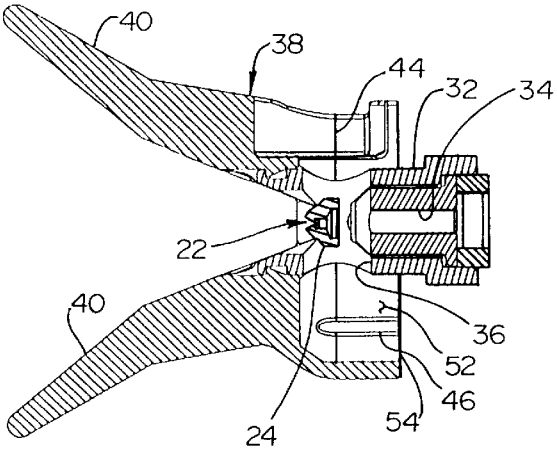
FIG. 5 is a view similar to that of FIG. 4, except with the reversible tip and nut omitted.
Figure 6:
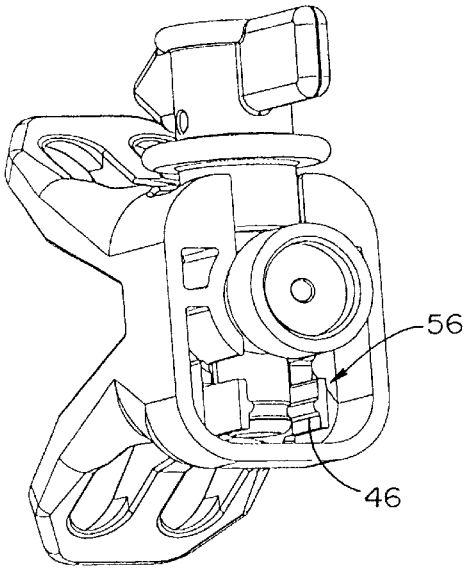
FIG. 6 is a perspective view of a second embodiment of the tip holder and reversible tip assembly.
Figure 8:
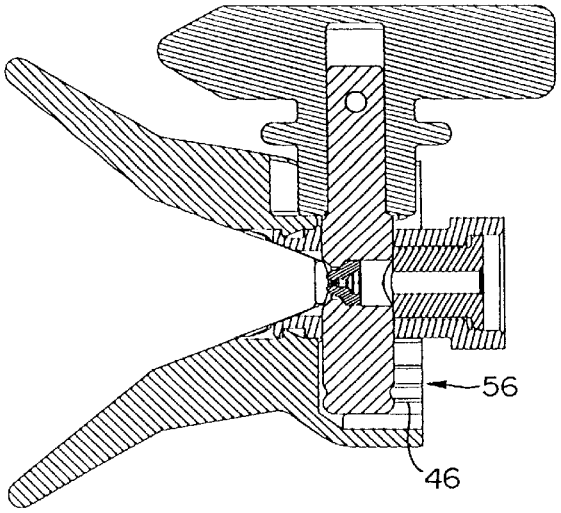
FIG. 8 is a side elevation view in section taken along line 8—8 of FIG. 7.
Figure 7:
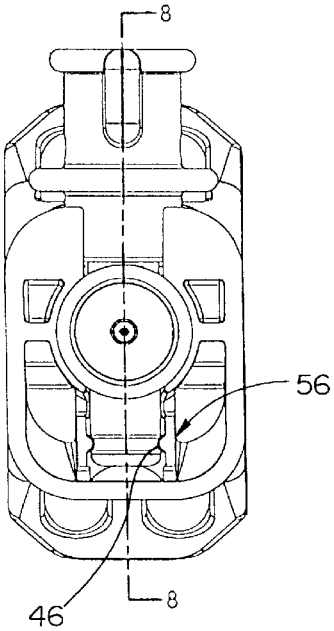
FIG. 7 is a rear elevation view of the assembly of FIG. 6.
Figure 9:
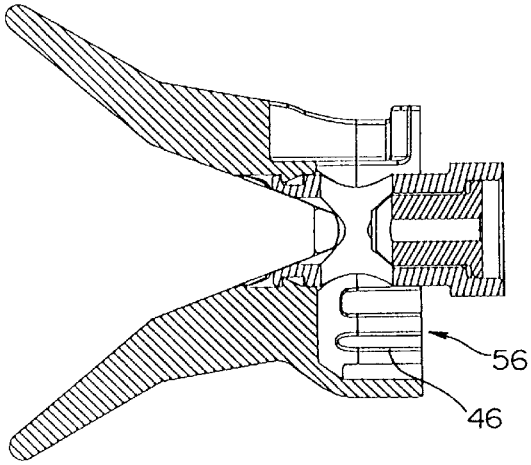
FIG. 9 is a view similar to that of FIG. 8, except with the reversible tip removed.
Figure 11:
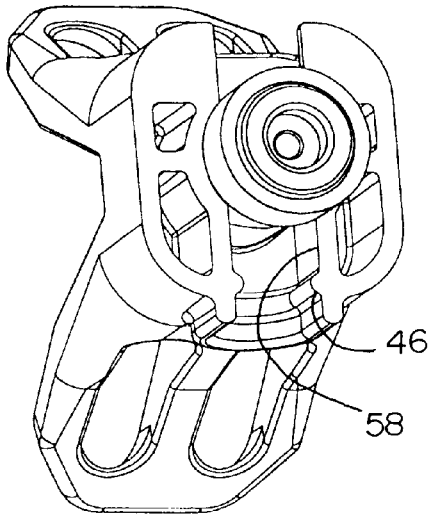
FIG. 11 is a perspective view of a third embodiment of the tip holder of the present invention.
Figure 14:
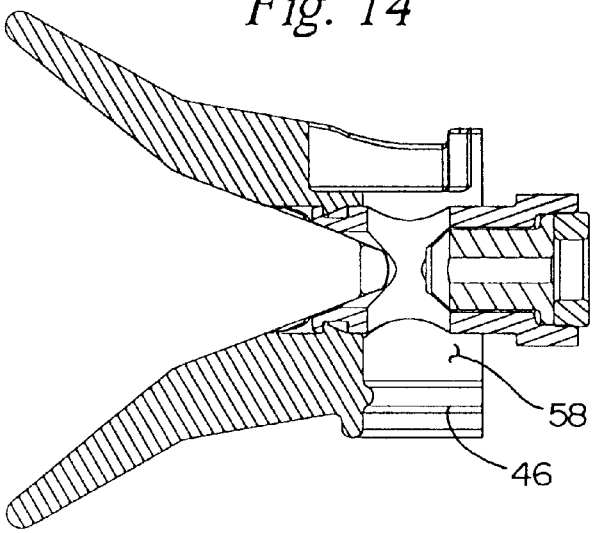
FIG. 14 is a fragmentary side section view similar to that of FIG. 13, except with the reversible tip removed.
Figure 12:
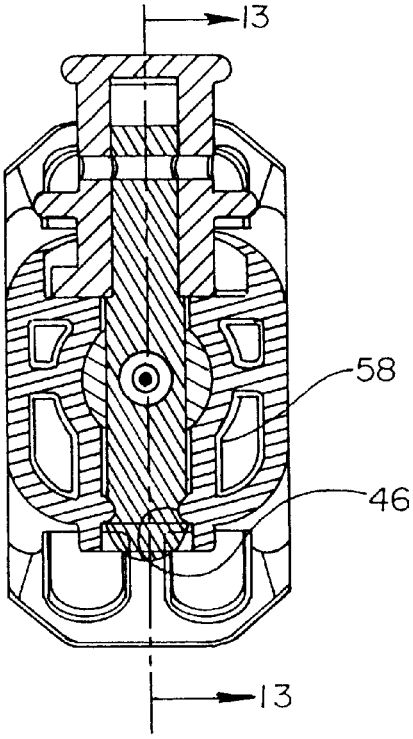
FIG. 12 is a rear elevation view in section of the tip holder of FIG. 11 together with a reversible tip, taken along line 12—12 of FIG. 13.
Figure 13:
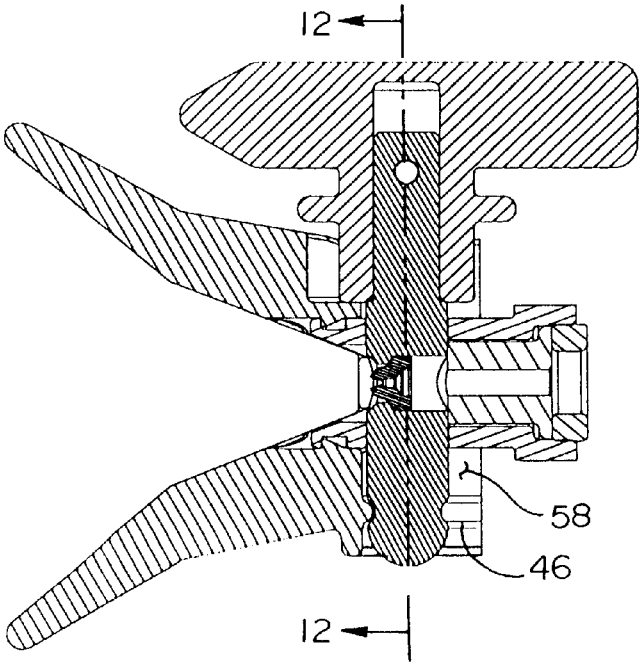
FIG. 13 is a side section view taken along line 13—13 of FIG. 12.

Referring to the Figures, and most particularly to FIG. 1, a portable paint spray gun 20 may be seen. Spray gun 20 is an airless type that uses a small orifice 22 in a spray tip 24 (see FIG. 5) to atomize paint using relatively high pressure. Referring now also to FIGS. 2, 3, and 4, spray tip 24 is preferably held in a reversible turret 26. Tip 24 is shown in a spraying position without the turret in FIG. 5 to show the relative location of parts in the spray tip assembly 28. It is to be understood that the assembly or apparatus 28 is preferably secured to gun 20 by a nut 30 which is omitted from many of the Figures only for simplicity.

Assembly 28 includes a tip holder 32 having a longitudinal paint passage 34 therethrough and a transverse bore 36 for rotatably receiving the reversible turret 26. Assembly 28 also includes a guard 38 having a pair of wings 40. The assembly or apparatus 28 also includes the paint spray tip 24 and turret 26 received in the transverse bore 36 of the tip holder 32.

Apparatus 28 also includes a detent means 42 for restraining the tip 24 (and turret 26) against unintentional separation from the holder 32 regardless of the angular position of the tip 24 with respect to the holder 32, and at the same time, permits rotation of the tip 24 in the holder 32 and also permits selective disengagement of the tip 24 and turret 26 from the holder 32 when a separating force is applied which is sufficient to overcome the restraining force of the detent means 42. The separating force is normally applied by pulling the turret 26 away from the holder 32 along the axis 44 of the transverse bore 36.

The detent means of the present invention is preferably in the form of a first portion made up of a protrusion on the tip holder extending radially into the transverse bore, and a second portion of a circumferential recess and shoulder on the turret. The projection is aligned with the recess when the tip is fully inserted in the holder and the protrusion must move past the shoulder to remove or insert the turret into the holder. To aid in this a spring portion on one of the protrusion and shoulder to allow them to move away from each other as the turret is engaged and disengaged from the holder. In the embodiments shown, the protrusion is located on the spring portion, which may be a part of the tip holder.

In the embodiment shown in FIGS. 2–5, the detent means 42 is made up of protrusion 46, together with recess 48 and shoulder 50. Protrusion 46 is in the form of a pair of elongated ribs formed as a part of a thin-walled section 52 of holder 32. Recess 48 and shoulder 50 are formed on the turret 26. The thin-walled section 52 serves as the spring portion, allowing the ribs to move radially outward when shoulder 50 moves along axis 44 as the turret is moved into or out of the holder 32. In this embodiment, the thin-walled section 52 is joined at opposite ends thereof to the tip holder 32, and the protrusion 46 extends generally along an axis perpendicular to the tip and the thin-walled section has an edge 54 that extends generally perpendicularly to the axis of the protrusion 46.

Referring now particularly to FIGS. 6–10, an alternative embodiment of the present invention is shown. In this embodiment, the protrusion 46 extends generally along an axis perpendicular to the tip and has a thin-walled section 56 that is cantilevered to extend generally parallel to the axis of the protrusion 46. It is to be understood that the cantilevered thin-walled section 56 serves as the spring portion of the detent means 42. In this embodiment, the thin-walled section 56 will deflect away from the turret 26 as the turret 26 is inserted and extracted from the tip holder 32.

Referring now particularly to FIGS. 11–14, another alternative embodiment of the present invention has the spring portion formed as a part of a generally thick-walled portion 58 of the tip holder 32. In addition, the protrusion 46 extends around a recess in the tip holder 32 in a generally U-shaped continuous projection. In this embodiment, the spring rate or spring constant of the spring portion will generally be substantially higher than that of the previous embodiments.

Figure 15:
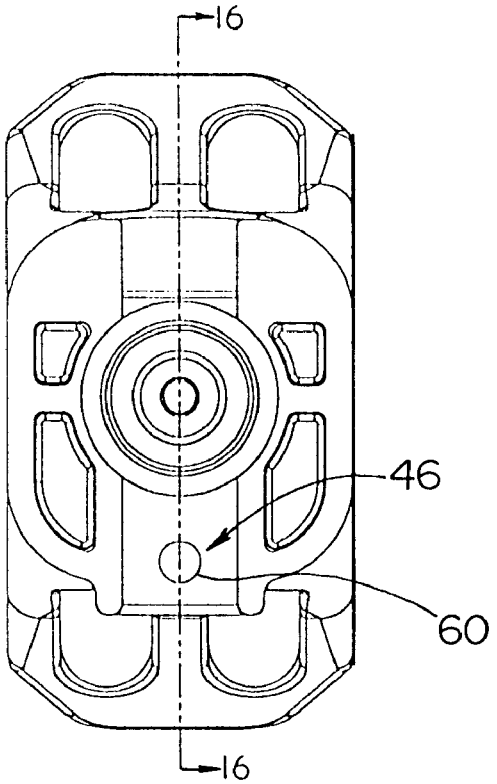
FIG. 15 is a rear elevation view of a fourth embodiment of the tip holder of the present invention.
Figure 16:
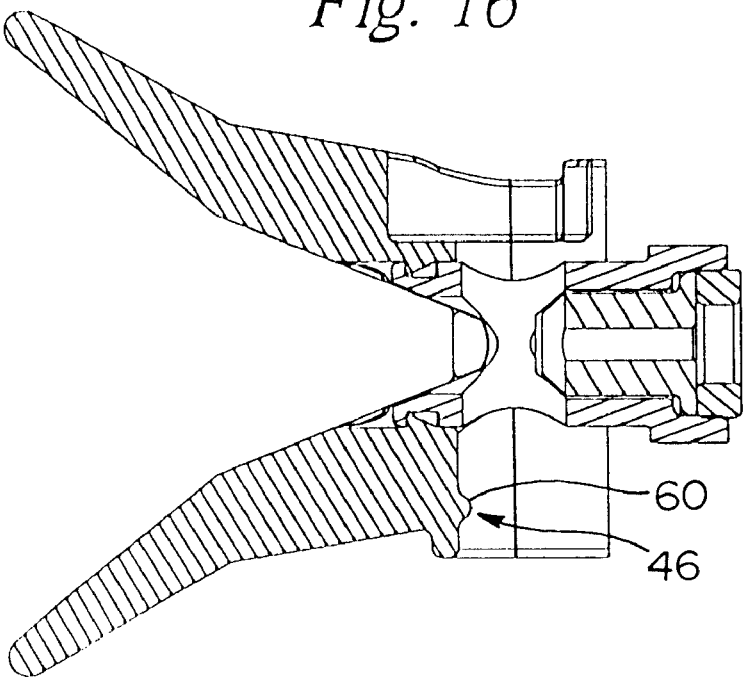
FIG. 16 is a side elevation view in section of the tip holder taken along line 16—16 of FIG. 15.

A still further embodiment may be seen in FIGS. 15 and 16, where the protrusion 46 is in the form of a paraboloid 60.

In each of the embodiments shown, the tip holder 32 is preferably made of type ST 801 Nylon and the turret 26 is preferably steel.

The invention is not to be taken as limited to all of the details thereof as modifications and variations thereof may be made without departing from the spirit or scope of the invention. For example, other forms of protrusions and mating recesses and shoulders may be used, and the location of the spring portion may be relocated to support the shoulder instead of the protrusion, if desired, all the while remaining within the scope of the present invention.

What is claimed is:

1. Apparatus for selectively retaining a reversible paint spray tip carried in a turret in a holder while simultaneously permitting rotation of the tip with respect to the holder, comprising:

a) a tip holder having a longitudinal paint passage therethrough and a transverse bore thereacross for rotatably receiving a rotatable turret therein;

b) a turret carrying a paint spray tip and rotatably received in the transverse bore of the tip holder; and c) detent means having a first portion located on the tip holder and a second portion located on the turret and a spring portion formed integrally on one of the first and second portions of the detent means for i) permitting rotation of the turret in the holder, ii) providing a restraining force against unintentional separation of the turret from the holder regardless of the angular position of the turret, and iii) permitting selective disengagement of the turret from the holder upon application of a separating force sufficient to overcome the restraining force of the detent means without requiring radial displacement of the holder from the turret to permit such disengagement.

2. The apparatus of claim 1 wherein the first portion of the detent means comprises a protrusion extending radially into the transverse bore, and the second portion of the detent means comprises a circumferential recess and shoulder adjacent thereto in the turret aligned with the protrusion when the turret is fully inserted in the holder.

3. The apparatus of claim 2 wherein the spring portion on one of the protrusion and shoulder allows the protrusion and shoulder to move away from each other as the turret is engaged and disengaged from the holder.

4. The apparatus of claim 3 wherein the protrusion is located on the spring portion.

5. The apparatus of claim 4 wherein the spring portion comprises a thin-walled section joined at least at one end thereof to the tip holder.

6. The apparatus of claim 5 wherein the thin-walled section is joined at opposite ends thereof to the tip holder.

7. The apparatus of claim 5 wherein the protrusion extends generally along an axis perpendicular to the turret and the thin-walled section has an edge that extends generally perpendicular to the axis of the protrusion.

8. The apparatus of claim 5 wherein the protrusion extends generally along an axis perpendicular to the turret and the thin-walled section is cantilevered to extend generally parallel to the axis of the protrusion.

9. The apparatus of claim 4 wherein the spring portion is located on a generally thick-walled portion of the tip holder.

10. The apparatus of claim 2 wherein the protrusion comprises a paraboloid.

11. A method of selectively retaining a reversible paint spray tip carried by a turret in a holder while simultaneously permitting rotation of the turret with respect to the holder comprising the steps of:

a) providing a detent means having a first portion located on the tip holder and a second portion located on the turret with a spring portion formed integrally with one of the first and second portions of the detent means for i) permitting rotation of the turret in the holder, ii) providing a restraining force against unintentional separation of the turret from the holder regardless of the angular position of the turret, and iii) permitting selective disengagement of the turret from the holder upon application of a separating force sufficient to overcome the restraining force of the detent means without requiring radial displacement of the holder from the turret to permit such disengagement;

b) moving the turret into a transverse bore of the tip holder such that the first and second portions of the detent means interengage one another;

c) rotating the turret in the tip holder as necessary to clear the tip when it becomes clogged; and d) urging the turret out of the transverse bore of the tip holder with sufficient force to disengage the first and second portions of the detent means from each other, permitting removal of the turret from the tip holder.

12. The method of claim 11 wherein step b) further comprises moving a shoulder on the turret past a protrusion on the tip holder by deflecting the protrusion against a spring portion of the tip holder supporting the protrusion.

13. The method of claim 12 wherein the spring portion comprises a thin-walled section of the tip holder.

14. The method of claim 12 wherein the spring portion comprises a cantilevered extension of the tip holder.

15. The method of claim 12 wherein the spring portion comprises a thick-walled section of the tip holder.

16. The method of claim 15 wherein the protrusion is generally U-shaped.

17. The method of claim 12 wherein the protrusion is a paraboloid.

* * * * *